US005901169A

United States Patent [19]

Kobayashi

[11] Patent Number: 5,901,169

[45] Date of Patent: May 4, 1999

[54] APPARATUS FOR DISCHARGING MOLTEN MATTER FROM COLD CRUCIBLE INDUCTION MELTING FURNACE

[75] Inventor: Hiroaki Kobayashi, Hitachinaka, Japan

[73] Assignee: Japan Nuclear Cycle Development Institute, Ibaraki-ken, Japan

[21] Appl. No.: 08/992,709

[22] Filed: Dec. 17, 1997

[30] Foreign Application Priority Data

Jan. 9, 1997 [JP] Japan ..... 9-001798

[51] Int. Cl.[6] ..... F27D 3/00

[52] U.S. Cl. ..... 373/142; 373/146; 373/156; 373/59; 75/10.14; 588/19

[58] Field of Search ..... 373/142, 145, 373/146, 147, 148, 149, 151, 155, 156, 163, 42, 59; 65/128; 588/19, 15, 231; 75/10.14, 10.18

[56] References Cited

U.S. PATENT DOCUMENTS

| | | | |
|---|---|---|---|
| 3,702,368 | 11/1972 | Hukin | 373/156 |
| 4,402,724 | 9/1983 | Weisenburger et al. | 65/128 |
| 4,762,553 | 8/1988 | Savage et al. . | |
| 4,770,718 | 9/1988 | Verhoeven et al. | 148/11.5 P |
| 4,811,356 | 3/1989 | Havas . | |
| 5,060,914 | 10/1991 | Wang et al. | 266/236 |
| 5,164,097 | 11/1992 | Wang et al. | 222/590 |
| 5,457,264 | 10/1995 | Kobayashi et al. | 588/19 |
| 5,564,102 | 10/1996 | Igarashi et al. | 588/11 |

FOREIGN PATENT DOCUMENTS

| | | |
|---|---|---|
| 2 688 516 | 9/1993 | France . |
| 1166789 | 10/1969 | United Kingdom . |
| 2 279 543 | 1/1995 | United Kingdom . |

*Primary Examiner*—Tu B. Hoang
*Attorney, Agent, or Firm*—Wenderoth, Lind & Ponack, L.L.P.

[57] ABSTRACT

Molten matter is discharged from a cold crucible induction melting furnace provided with a furnace body disposed within a high-frequency coil for heating the furnace body. A metallic discharging nozzle extends downwardly from an inner bottom portion of the furnace body and can be electrically insulated from the furnace body. A high-frequency coil for heating the discharging nozzle is disposed around the nozzle. An electric circuit for removing high-frequency noise generated from the high-frequency coil for heating the furnace body is disposed in the high-frequency coil for heating the nozzle. High reliability and high controllability can be achieved without electric short-circuits between the furnace body and the nozzle and noise interference between the high-frequency coils.

17 Claims, 4 Drawing Sheets

APPARATUS FOR DISCHARGING MOLTEN MATTER FROM COLD CRUCIBLE INDUCTION MELTING FURNACE

BACKGROUND OF THE INVENTION

This invention relates to a molten matter discharging apparatus for efficiently and reliably discharging molten matter formed inside a furnace when substances to be melted such as metals are induction-heated by using a cold crucible induction melting furnace.

A cold crucible induction melting furnace has a construction in which a divided, water-cooled metallic cold crucible is disposed inside a water-cooled high-frequency coil. When substances to be melted such as metals are charged into such melting furnace and a high-frequency current is supplied to the high-frequency coil, the metals are induction-heated and are converted to molten matter. In this instance, a floating force acts on the molten matter itself due to an electromagnetic field, and the molten matter does not come into direct contact with a furnace body of the melting furnace. Therefore, such induction melting furnace has the capability that materials having high melting points can be melted and erosion of the furnace body by the molten matter scarcely occurs. Furthermore, because the furnace body itself is cooled with water, high temperature melting of the substances to be melted can be achieved without being limited by the heat-resistant temperature of the furnace body. For these reasons, the cold crucible induction melting furnace has been utilized at present for melting special metals in the iron and steel industry.

On the other hand, a method for collectively and conveniently melting radioactive miscellaneous solid wastes including a variety of substances such as combustibles, metals, glass and other non-combustibles generated from nuclear facilities and the like by using such a cold crucible induction melting furnace has been proposed. (See U.S. Pat. No. 5,457,264 corresponding to Japanese Patent Laid-open No. 7-63895/1995; hereinafter referred to as "prior art method".)

In this prior art method, when the radioactive miscellaneous solid wastes are charged into the cold crucible induction melting furnace and a high-frequency current is supplied to the high-frequency coil, conductive substances contained in the miscellaneous solid wastes, such as metals, are first induction-heated and are melted. Due to the heat generated at this time, the remaining miscellaneous solid wastes having a low conductivity surrounding the metals also are indirectly heated. In other words, the metals function as a starting source of heating and the miscellaneous solid wastes are entirely melted.

By the prior art method, the molten metal does not come into direct contact with the furnace body because the floating force acts on the molten matter due to the operation of the electromagnetic field as described above. Also in the case of glass melting, the contact surface of the molten glass with the furnace body is cooled and is converted to a solid layer (skull layer), so that the direct contact of the high temperature molten glass with the furnace body does not occur. Thus, high temperature erosion of the furnace body does not occur, and high temperature melting of the substances to be melted becomes possible.

In order to carry out a continuous melting operation by using the cold crucible Induction melting furnace described above, the high temperature molten matter must be discharged from the furnace. Conventional methods of discharging the molten matter include a system which allows the molten matter to overflow from the furnace top by tilting the melting furnace itself, a system which allows the molten matter to flow down from an outflow port at the furnace bottom portion by pressurizing the inside of the furnace, and the like. However, the former system requires a moving structure for tilting the furnace body, and the latter requires a gas-tight structure of the furnace body.

On the other hand, a nozzle heating system (a freeze valve system) has been employed in the past for a glass melting furnace used in vitrification of high-level radioactive wastes. This system has a construction wherein heating means is disposed around a discharging nozzle extending downwardly from the furnace bottom portion. Since the molten glass inside the nozzle is solidified when the discharging nozzle is not heated, the molten glass inside the furnace does not flow down and is not discharged. To discharge the molten glass inside the furnace, the discharging nozzle is heated so as to melt the solidified glass inside the nozzle and allow it to flow down by gravity, and at the same time, the molten glass inside the furnace can be discharged.

As nozzle heating means in such nozzle heating system, there has been proposed a high-frequency heating means wherein a high-frequency coil is disposed around a metallic discharging nozzle and a high-frequency current is supplied to this coil to heat the nozzle. However, when this nozzle heating system is adopted as a molten matter discharging apparatus in a cold crucible induction melting furnace and the nozzle is heated by high-frequency heating, there remain the problems that the metallic furnace body and the metallic discharging nozzle are electrically short-circuited, and noise interference occurs between the high-frequency heating system for heating the furnace body and the high-frequency heating system for heating the discharging nozzle.

SUMMARY OF THE INVENTION

It is therefore an object of the present invention to provide a molten matter discharging apparatus used in a cold crucible induction melting furnace which employs a nozzle heating system as molten matter discharging means, can prevent electrical short-circuiting between a metallic furnace body and a metallic discharging nozzle when the nozzle is heated by high-frequency heating, eliminates the occurrence of noise interference between a high-frequency heating system for heating the furnace body and a high-frequency heating system for heating the discharging nozzle, and has high reliability and high controllability.

According to the present invention, there is provided an apparatus for discharging molten matter from a water-cooled cold crucible induction melting furnace provided with a furnace body disposed within a high-frequency coil for heating the furnace body. The apparatus comprises a discharging nozzle made of a metal and extending downwardly from an Inner bottom portion of the furnace body. The discharging nozzle can be electrically insulated from the furnace body. A high-frequency coil heats the discharging nozzle and is disposed around the nozzle. An electric circuit for removing high-frequency noise generated from the high-frequency coil for heating the furnace body is disposed in the high-frequency coil for heating the nozzle.

According to the present invention, the furnace body and the discharging nozzle can be electrically insulated from each other, and therefore electric short-circuiting therebetween can be reliably prevented. Furthermore, noise interference applied to the high-frequency heating system for heating the discharging nozzle from the high-frequency heating system for heating the furnace body can be effectively prevented. As a result, operations of discharge/stop of the molten matter from the discharging nozzle can be reliably controlled without being affected by the high-frequency heating system for heating the furnace body.

When the discharging nozzle is formed separately from the furnace body, electric insulation therebetween can be established by fixing the discharging nozzle to the furnace body by a member formed of electrically insulating material.

PREFERRED EMBODIMENTS OF THE INVENTION

Figure 1:
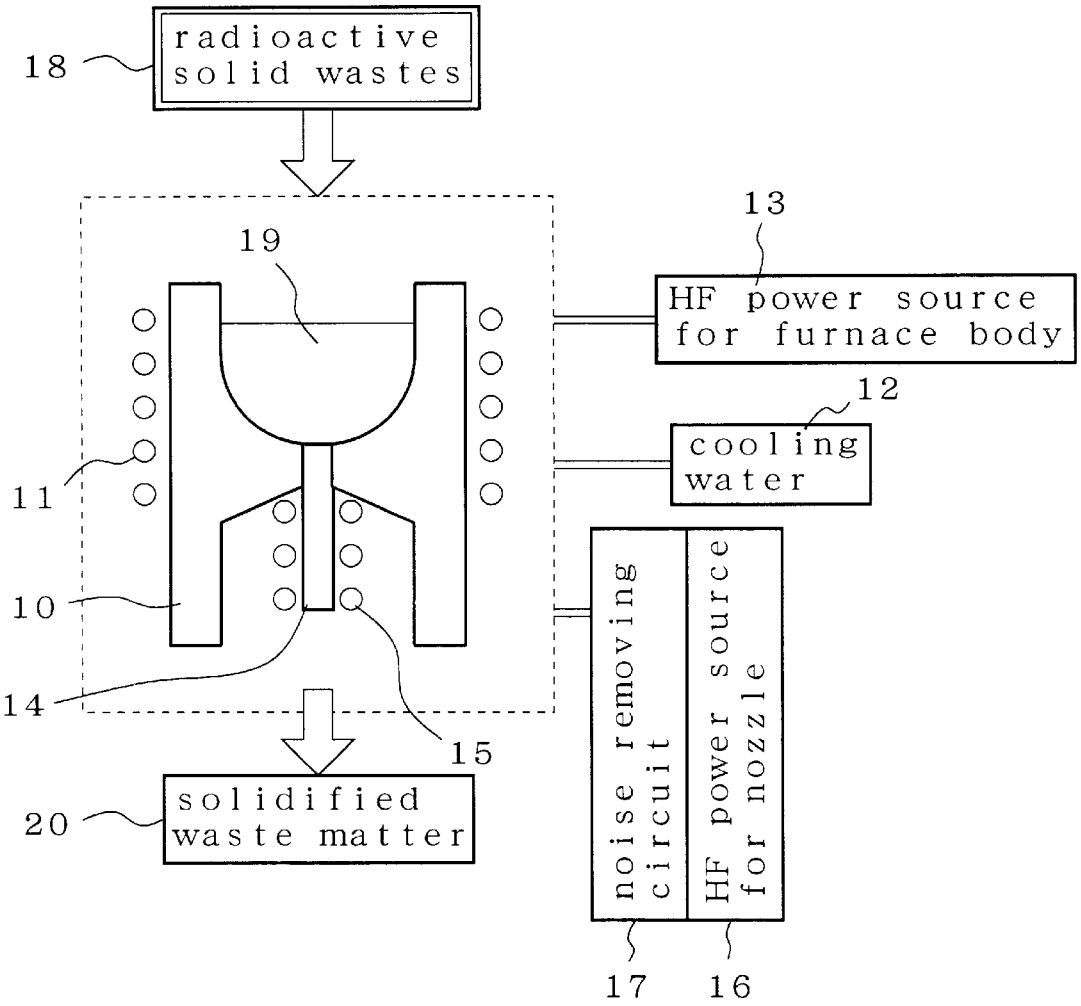
FIG. 1 is an explanatory view showing an embodiment of the present invention.

FIG. 1 shows a schematic structure of an apparatus for discharging molten matter from a cold crucible induction melting furnace according to an embodiment of the present invention. A slit-divided, water-cooled cold crucible 10 made of copper is disposed inside a water-cooled high-frequency coil 11 for heating a furnace body of the cold crucible in the same manner as in a conventional cold crucible induction melting furnace. The cold crucible 10 and the high-frequency coil 11 are cooled by circulating cooling water 12 inside them, and a high-frequency current having a predetermined frequency is supplied to the high-frequency coil 11 from a high-frequency power source 13 for heating the furnace body.

The molten matter discharging apparatus according to the present invention includes a metallic discharging nozzle 14 extending downward from an inner bottom portion of a furnace body of the cold crucible 10, a high-frequency coil 15 for heating the nozzle and disposed around the discharging nozzle, and a high-frequency power source 16 which supplies a high-frequency current having a predetermined frequency to the high-frequency coil 15. The present invention is constituted so that the furnace body of the cold crucible 10 and the discharging nozzle 14 can be electrically insulated, and a noise removing circuit 17 for removing high-frequency noise generated from the high-frequency coil 11 is interposed between the high-frequency coil 15 and the high-frequency power source 16.

A method of melting radioactive miscellaneous solid wastes and a method of discharging molten matter by using the cold crucible Induction melting furnace equipped with the molten matter discharging apparatus described above will be explained hereinbelow. After radioactive miscellaneous solid wastes 18 are charged into the cold crucible 10, the high-frequency current is supplied from the high-frequency power source 13 to the high-frequency coil 11 for heating the furnace body. Thus, electrically conductive substances such as metals contained in the miscellaneous solid wastes are first heated and melted by induction heating. The remaining miscellaneous solid wastes having a low conductivity such as glass are also heated indirectly, so that the wastes change to molten matter 19 as a whole. During this melting operation, the high-frequency current is not supplied to the high-frequency coil 15 and the discharging nozzle 14 is not heated. Consequently, the molten matter inside the nozzle is solidified and clogs the nozzle, so that the molten matter 19 inside the furnace does not flow through the nozzle.

In order to discharge the molten matter 19, the high-frequency current is supplied from the high-frequency power source 16 to the high-frequency coil 15 and the nozzle 14 thus is heated. Since the furnace body of the cold crucible 10 and the discharging nozzle 14 can be electrically insulated from each other, they will not electrically short-circuited and can be heated by high-frequency heating separately from each other. Further, noise interference from the high-frequency heating system for heating the furnace body to the high-frequency heating system for heating the nozzle can be effectively prevented by the noise removing circuit 17.

When the discharging nozzle 14 is heated, the solidified matter inside the nozzle is melted and is brought into a fluidized state, and then flows from the nozzle due to gravity. Upon this discharge of the molten matter from the nozzle, the high temperature molten matter inside the furnace also then is allowed to flow through the nozzle. The molten matter 19 is poured into a canister or a stainless steel vessel (not shown) so as to be cooled and solidified to become a solidified waste matter 20.

The supply of the high-frequency current from the high-frequency power source 16 to the high-frequency coil 15 is stopped when discharging of the molten matter 19 inside the cold crucible 10 is completed, and high-frequency heating of the discharging nozzle thus is stopped. As a result, the discharging nozzle is cooled gradually, and molten matter remaining inside the nozzle is solidified and closes the nozzle. In the case where it is desired to quickly cool the nozzle and to quickly accomplish closing of the nozzle after stopping the high-frequency heating of the nozzle, an air cooling pipe (not shown) for positively cooling the nozzle is preferably wound around the outside of the high-frequency coil 15.

Figure 2:
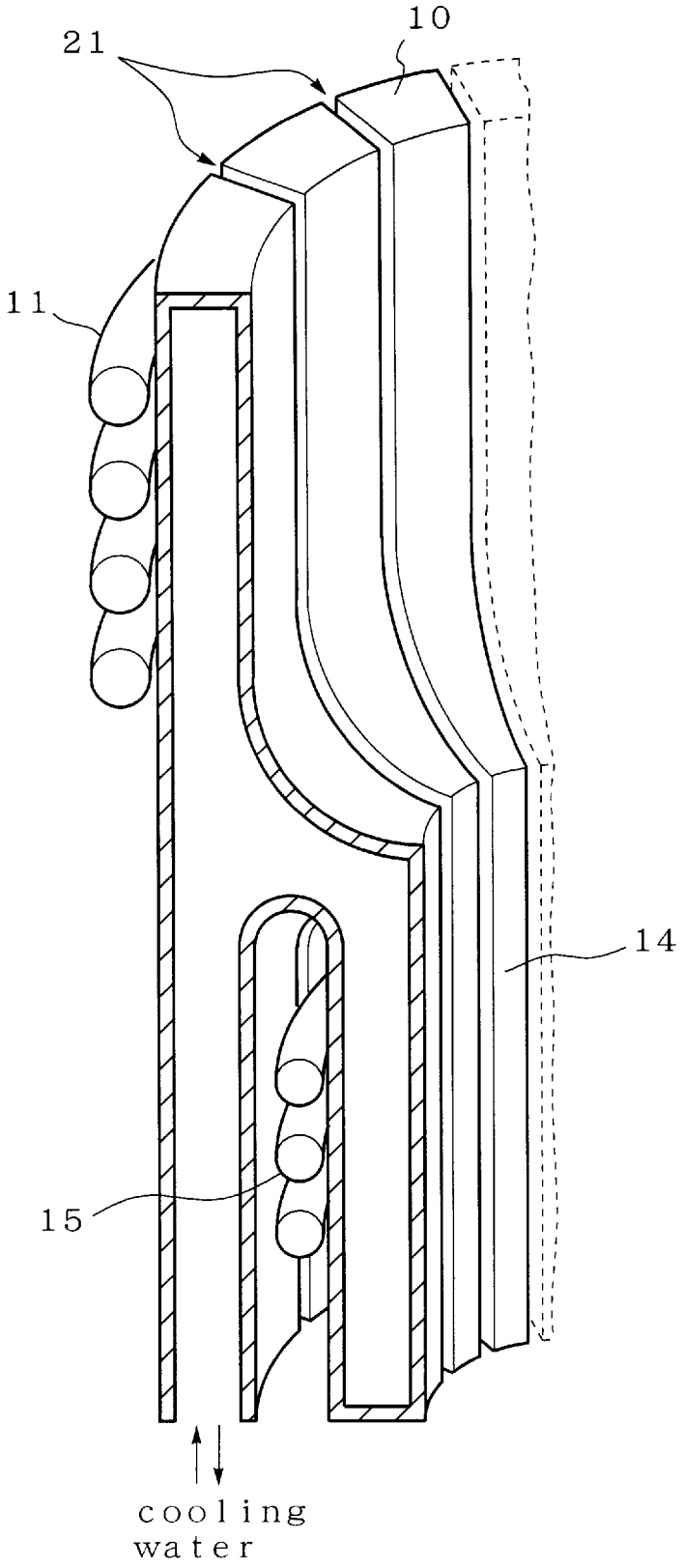
FIG. 2 is a partial sectional perspective view showing an example of a construction of a discharging nozzle and a cold crucible furnace body when they are formed as a unitary structure.
Figure 3A:
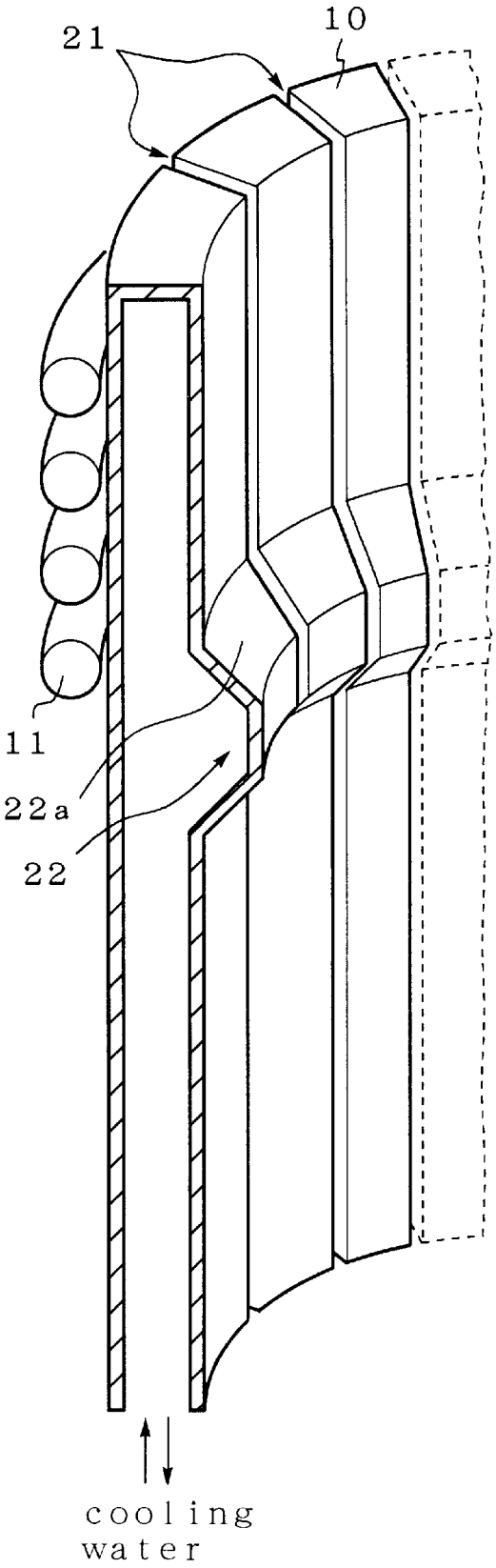
FIGS. 3A and 3B are perspective views showing the furnace body and the discharging nozzle, respectively, when the discharging nozzle used in the present invention is formed separately from the cold crucible furnace body.
Figure 3B:
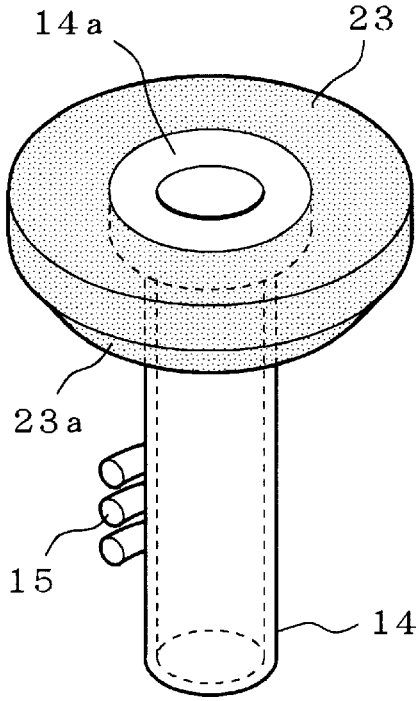
Figure 4:
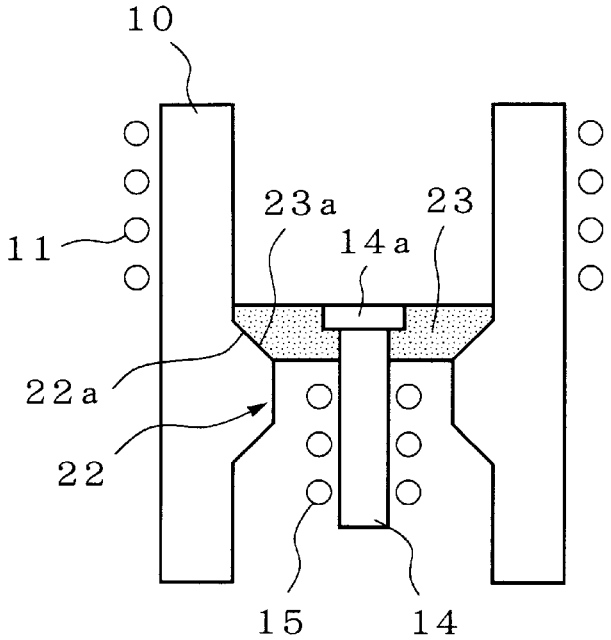
FIG. 4 is an explanatory view showing the state where the furnace body shown in FIG. 3A and the discharging nozzle shown in FIG. 3B are assembled.

FIGS. 2, 3 and 4 show structural examples of the cold crucible 10 and the discharging nozzle 14. FIG. 2 shows an example of the case where the furnace body of the cold crucible 10 and the discharging nozzle 14 are formed into a unitary structure. The furnace body of the cold crucible 10 is divided by a large number of insulating slits 21 and cooling water is allowed to flow inside each divided structure so as to cool the furnace body. The portion which is to serve as the discharging nozzle 14 is integral with and extends downwardly from the furnace inner bottom portion, and the slits 21 are also formed in the discharging nozzle portion 14 so as to communicate with the slits in the furnace body portion. An insulating material such as silicon nitride ($Si_3N_4$) is ordinarily inserted into insulating slits 21. However, since the current supplied to the high-frequency coil 15 for heating the nozzle has a frequency lower than that of the current supplied to the high-frequency coil 11 for heating the furnace body, insulation of the insulating slits 21 at the portion of the discharging nozzle may be achieved by air, and separate insulating material need not always be inserted.

The high-frequency coil 11 for heating the furnace body and the high-frequency coil 15 for heating the nozzle are wound around the outer periphery of the furnace body of the cold crucible 10 and the discharging nozzle 14, respectively.

FIG. 3 shows a structural example for achieving electrical insulation between the furnace body of the cold crucible 10 and the discharging nozzle 14 when they are formed as separate members. FIG. 3A shows the furnace body of the cold crucible 10. This furnace body is divided by a large number of insulating slits 21, an insulating material is inserted into each of the Insulating slits 21, and cooling water is allowed to flow inside each divided structure so as to cool the furnace body. This construction is the same as the construction shown in FIG. 2 but is different from the latter in that a portion 22 protruding inward is formed in the vicinity of a position serving as the bottom portion of the furnace body. FIG. 3B shows the discharging nozzle structures. A flange portion 14*a*having an increased diameter is formed at the upper end of the cylindrical discharging nozzle 14, and a ring-shaped member 23 formed of insulating material is fixed to the upper portion of the discharging nozzle 14 inclusive of the flange portion. The lower periphery of the ring-shaped member 23 is chamfered to define a taper surface 23*a*. FIG. 4 shows an assembled state of the furnace body shown in FIG. 3A and the discharging nozzle structure shown in FIG. 3B. The taper surface 23*a* is supported by a taper surface 22*a* of the inward protruding portion 22 of the furnace body, and the top face of the ring-shaped member 23 serves as the inner surface of the furnace bottom. Because the ring-shaped member 23 comes into direct contact with the high temperature molten matter, silicon nitride having excellent high temperature erosion resistance can be used preferably.

Figure 5:
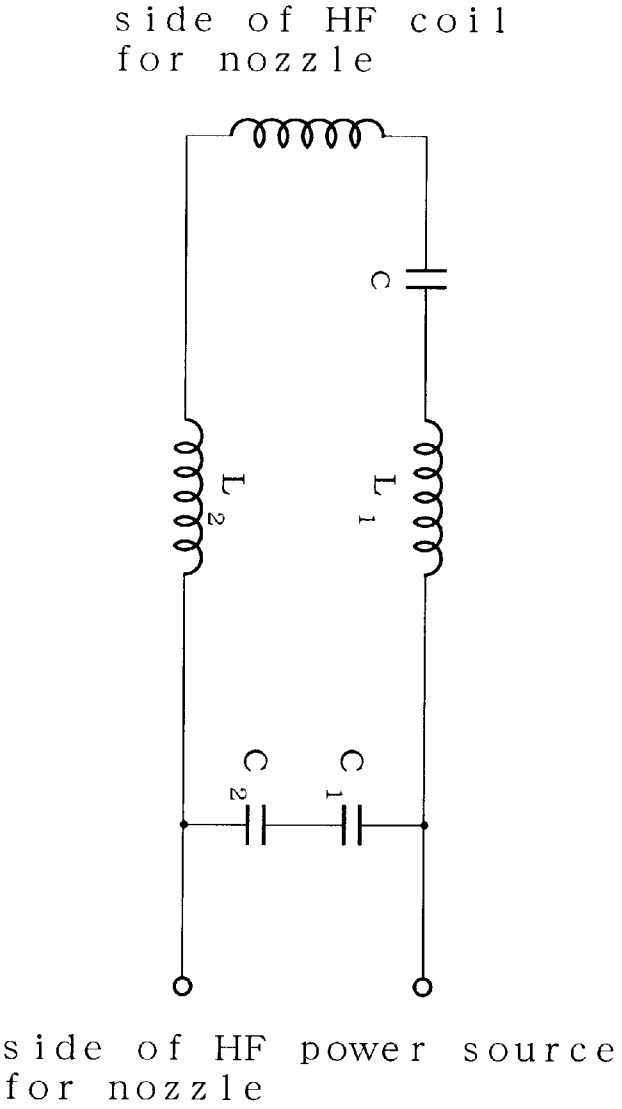
FIG. 5 Is a circuit diagram showing an example of a noise removing circuit used in the present invention.

The noise removing circuit 17 will be explained hereinbelow. The phenomenon in which a high-frequency magnetic field affects other electric circuits and creates problems in circuits and components, referred to as "noise trouble", and the influence of such noise trouble generally becomes greater with a higher output and a higher frequency. In the present invention, the influence of the furnace body heating system having a high-frequency of 4 MHz, for example, on the nozzle heating system having a relatively low frequency of about 20 kHz, for example, must be removed. Therefore, the present invention interposes an ordinary LC circuit comprising the combination of suitable inductances $L_1$ and $L_2$ and capacitances C, $C_1$ and $C_2$ between the high-frequency coil 15 and the high-frequency power source 16 as shown in FIG. 5, so as to suppress the noise trouble from the furnace body heating system. Incidentally, the capacitances of L and C in the circuit can be set appropriately in consideration of the frequency of the high-frequency, the electric resistances of the substances to be melted, and the like.

Although the embodiments described above have been explained with reference to an example using radioactive miscellaneous solid wastes as substances to be melted, any materials or substances can be used as an objective article to be melted so long as they can be melted by high-frequency heating, such as metals, glass and the like.

Hereinbelow, the present invention will be explained with reference to an experimental example thereof. The cold crucible induction melting furnace used had the same construction as the apparatus shown in FIG. 1. A furnace body made of copper and having an inner diameter of 100 mm and a depth of 150 mm was divided into ten segments. A high-frequency coil for the furnace body had an outer diameter of 170 mm, a height of 100 mm and seven turns.

A discharging nozzle was formed separately from the furnace body as shown in FIGS. 3A and 3B, and such two components were assembled when used, as shown in FIG. 4. The discharging nozzle was made of a nickel alloy (Inconel 690) and had a pore diameter of 25 mm and a length of 260 mm. A high-frequency coil 15 for nozzle 14 had an inner diameter of 45 mm, a length of 280 mm and 15 turns. An air cooling pipe for cooling the discharging nozzle, made of copper, was wound around the outside of the high-frequency coil 15.

An LC circuit, as shown in FIG. 5, was disposed as a noise removing circuit upstream of a high-frequency power source 16 for the nozzle, wherein both $L_1$ and $L_2$ were 2.2 H and both $C_1$ and $C_2$ were 103 pF.

About 1,000 g of borosilicate glass beads were charged as a substance to be melted into the furnace and were melted by supplying a high-frequency current having an output of 50 kW and a frequency of 4 MHz from a high-frequency power source 13 to the high-frequency coil 11. The melting temperature was about 1,300° C. To discharge molten glass inside the furnace, a high-frequency current having an output of 10 kW and a frequency of 20 kHz was supplied to the high-frequency coil 15 from the high-frequency power source 16 and the discharging nozzle 14 was heated to about 1,000° C. As a consequence, the full amount of about 1,000 g of the glass molten matter inside the furnace could be allowed to be discharged within about 1.5 minutes.

Noise from the high-frequency heating system for the furnace body could be suppressed effectively without inviting noise troubles, such as abnormal oscillation or troubles in the oscillation circuit, in the high-frequency heating system for the nozzle.

As can be understood from the foregoing, the molten matter discharging apparatus according to the present invention includes the discharging nozzle extending downwardly from the inner bottom of the cold crucible induction melting furnace. This discharging nozzle is heated by high-frequency energy in order to cause the molten matter in the furnace to flow through the nozzle, or such heating is ceased to stop such flow. Therefore, the present invention eliminates the necessity for a moving structure which is required for the furnace body tilting system in the conventional molten matter discharging apparatus and the gas-tight structure required for the furnace pressurization system, and can efficiently discharge a high temperature molten matter and can therefore attain a continuous melting operation.

Even when the metallic furnace body of the cold crucible and the metallic discharging nozzle are heated by high-frequency heating using high-frequency currents having mutually different frequencies, the present invention can prevent short-circuits therebetween by providing electric insulation between the furnace body and the nozzle. Furthermore, because the present invention can effectively suppress noise interference from the high-frequency heating system for the furnace body to the high-frequency heating system for the nozzle by using the noise removing circuit, it becomes possible to discharge the molten matter with high reliability and high controllability.

What is claimed is:

1. A furnace comprising a furnace body for containing matter, a first high-frequency coil surrounding said furnace body for heating said furnace body and melting the matter to form molten matter, and an apparatus for discharging the molten matter from said furnace body, said apparatus comprising:

a metal discharging nozzle extending downwardly from an inner bottom portion of said furnace body, said nozzle being electrically insulated from said furnace body;

a second high-frequency coil disposed around said nozzle for heating said nozzle; and an electric circuit connected to said second high-frequency coil for removing high-frequency noise generated from said first high-frequency coil.

2. A furnace as claimed in claim 1, wherein said furnace body and said nozzle are separate components, and further comprising a member formed of electrically insulating material positioned between said nozzle and said furnace body.

3. A furnace as claimed in claim 2, wherein said member is ring-shaped.

4. A furnace as claimed in claim 2, wherein said electrically insulating material comprises silicon nitride.

5. A furnace as claimed in claim 1, comprising a water-cooled cold crucible induction melting furnace.

6. A furnace as claimed in claim 1, wherein said furnace body is formed of metal.

7. A furnace as claimed in claim 1, further comprising a first high-frequency power source connected to said first high-frequency coil for supplying high-frequency energy thereto.

8. A furnace as claimed in claim 7, further comprising a second high-frequency power source connected to said second high-frequency coil for supplying high-frequency energy thereto.

9. A furnace as claimed in claim 8, wherein said electric circuit is disposed between said second high-frequency power source and said second high-frequency coil.

10. A furnace as claimed in claim 1, further comprising a high-frequency power source connected to said second high-frequency coil for supplying high-frequency energy thereto.

11. A furnace as claimed in claim 10, wherein said electric circuit is disposed between said high-frequency power source and said second high-frequency coil.

12. An apparatus for discharging molten matter from a furnace including a furnace body for containing matter and a first high-frequency coil surrounding the furnace body for heating the furnace body and melting the matter to form molten matter, said apparatus comprising:

a metal discharging nozzle to be mounted to extend downwardly from an inner bottom portion of the furnace body;

a member to electrically insulate said nozzle from the furnace body;

a second high-frequency coil disposed around said nozzle for heating said nozzle; and an electric circuit connected to said second high-frequency coil for removing high-frequency noise generated from the first high-frequency coil of the furnace.

13. An apparatus as claimed in claim 12, wherein said member is formed of electrically insulating material and is adapted to be positioned between said nozzle and the furnace body.

14. An apparatus as claimed in claim 13, wherein said member is ring-shaped.

15. An apparatus as claimed in claim 13, wherein said electrically insulating material comprises silicon nitride.

16. An apparatus as claimed in claim 12, further comprising a high-frequency power source connected to said second high-frequency coil for supplying high-frequency energy thereto.

17. An apparatus as claimed in claim 16, wherein said electric circuit is disposed between said high-frequency power source and said second high-frequency coil.

* * * * *